United States Patent [19]

Clancy

[11] Patent Number: 4,658,696

[45] Date of Patent: Apr. 21, 1987

[54] PEDAL KEYBOARD OPERATED MUSICAL INSTRUMENT

[76] Inventor: Patrick J. Clancy, 1195 Mee La., St. Helena, Calif. 94574

[21] Appl. No.: 671,912

[22] Filed: Nov. 16, 1984

[51] Int. Cl.[4] ..... G10C 3/14

[52] U.S. Cl. ..... 84/444; 84/DIG. 25; 84/426

[58] Field of Search ..... 84/72–78, 84/225–232, 353, 357, 358, 366, 426, 444, DIG. 25

[56] References Cited

U.S. PATENT DOCUMENTS

| | | | |
|---|---|---|---|
| 2,499,244 | 2/1950 | Hammond et al. | 84/426 |
| 3,546,995 | 12/1970 | Semprevivo | 84/444 |
| 4,278,004 | 7/1981 | Klann | 84/434 |

*Primary Examiner*—Lawrence R. Franklin

*Attorney, Agent, or Firm*—Harris Zimmerman; Howard Cohen

[57] ABSTRACT

A pedal keyboard operated musical instrument includes a keyboard housing formed as a shallow, upwardly opening coffer. A spacer bar extends laterally in the housing, with a plurality of spring bars arrayed in parallel fashion and secured atop the spacer bar in generally orthogonal relationship thereto. The spacer bar bisects the longitudinal extent of the spring bars, which are unsupported at their opposed ends. A first and second plurality of pedal keys are secured to the spring bars, in alternating fashion, with each key of one plurality disposed between a pair of the keys of the other plurality. In addition, each key of one plurality is secured to one end of each spring bar, with a key of the other plurality secured to the other end of the respective spring bar. The keys of the one plurality are provided with blocks extending upwardly therefrom to extend above the nominal height of the second plurality, the blocks being adjustable in the longitudinal distance from the medial spacer bar. A plurality of electrical switches are provided, each disposed at the distal end of one of the keys to sense depression thereof. The keys are adapted to be played by the foot, using a heel-and-toe rocking motion. The notes ascribed to the keys may be selected electronically, and generally comprise the notes of major and harmonic minor chords commonly used in bass accompaniment.

9 Claims, 7 Drawing Figures

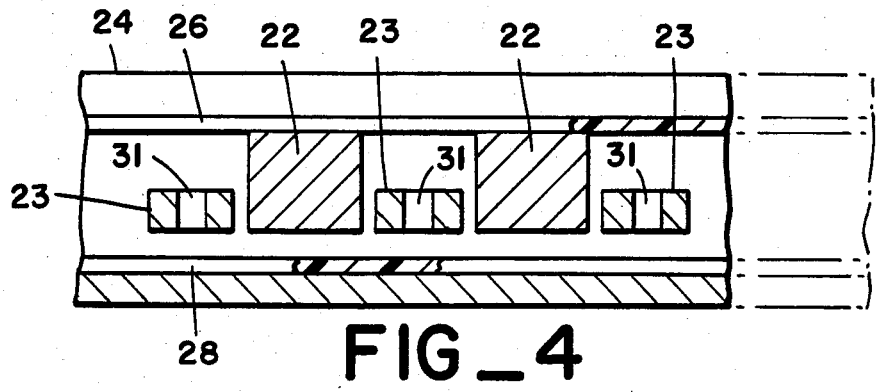
FIG_4
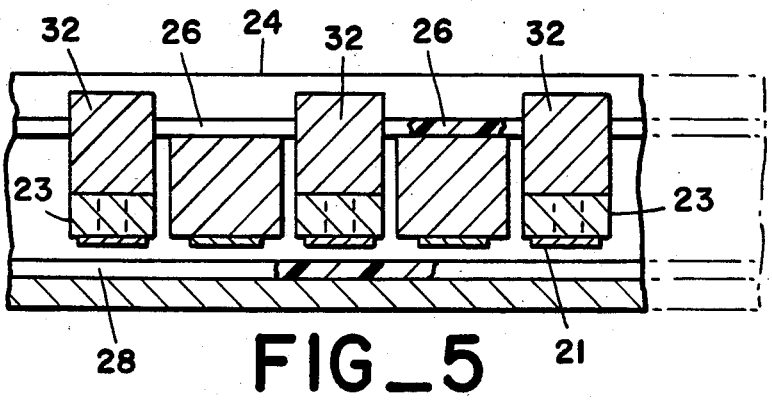
FIG_5
STRAIGHT MAJOR
| | | | | | | | | | | | | | |
|---|---|---|---|---|---|---|---|---|---|---|---|---|---|
| | $B^b$ | | F | | C | | G | | D | | A | | B |
| $B^b$ | D | F | A | © | E | G | B | D | $F^\#$ | A | $C^\#$ | E | $G^\#$ |
| $G^b$ | | $D^b$ | | $A^b$ | | $E^b$ | | $B^b$ | | F | | C | |
FIG_6
STANDARD PEDAL No. 1
| | | | | | | | | | | | | | |
|---|---|---|---|---|---|---|---|---|---|---|---|---|---|
| | $C^\#$ | | $D^\#$ | | F | | $F^\#$ | | $G^\#$ | | $A^\#$ | | C |
| C | $C^\#$ | D | $D^\#$ | E | F | F | $F^\#$ | G | $G^\#$ | A | $A^\#$ | B | C |
| C | | D | | E | | F | | G | | A | | B | |
FIG_7

PEDAL KEYBOARD OPERATED MUSICAL INSTRUMENT

BACKGROUND OF THE INVENTION

The following U.S. patents comprise the closest known prior art: U.S. Pat. Nos. 2,625,070, 2,900,862, 3,155,760, 3,319,502, 3,320,844, 3,443,470, 3,527,134, 3,546,995, 3,761,598, 3,789,722.

The extensive listing of prior art indicates that there are known in the prior art many musical instrument keyboards which are adapted to be played in pedal fashion by the foot. Generally speaking, these keyboards are arranged with the keys defining the same scale patterns as a standard piano keyboard; i.e., the familiar 12 note repetitive pattern in side-by-side relationship. Although this arrangement is consonant with the accepted note layout, it does not provide convenient foot access to the notes most often played in a bass accompaniment. For example, the third, fifth, seventh, and octave intervals frequently used in bass accompaniment to piano or guitar require substantial lateral excursions of the foot, thereby increasing the time required to play these notes and the fatigue to the foot and leg. More importantly, these long lateral excursions may often result in poor placement of the foot and errors in the accompaniment. It is quite clear that the foot does not have the sensitivity nor the aptitude of the hand for striking the proper key.

One example of a prior art attempt to overcome this shortcoming is found in U.S. Pat. No. 3,546,995, cited above. This device provides two rows of keys arrayed in lateral opposition with respect to a medial pivot shaft. The keys may be played with the heel and toe, thus placing more keys within easy reach of the foot without long lateral excursions. In this device all keys are arrayed in a common linear or curved plane, with no tactile differences available to the musician to indicate differing keys. Also, each pair of opposed keys are actually a common bar pivotally joined to a medial pivot bar in seesaw fashion, rendering playing of these keys in rapid succession more difficult. Furthermore, the note arrangement ascribed to the keys is not convenient for playing bass accompaniment lines.

SUMMARY OF THE PRESENT INVENTION

The present invention generally comprises a novel pedal keyboard arrangement which optimizes playing music and musical accompaniment with the foot. Among its salient features the invention provides two opposed rows of pedal keys for playing with the heel and toe of the foot, so that more keys are available within a short lateral reach. Furthermore, every other key is provided with an adjustable block extending upwardly therefrom above the adjacent pair of keys to provide tactile indication of the location of the foot on the keyboard. Also, each key is supported and actuated independently, rather than in pairs or the like.

The pedal keyboard operated musical instrument includes a keyboard housing formed as a shallow, upwardly opening rectangular coffer. A spacer bar extends laterally in the housing, with a plurality of spring bars arrayed in parallel fashion and secured atop the spacer bar in generally orthogonal relationship thereto. The spacer bar bisects the longitudinal extent of the spring bars, which are unsupported at their opposed ends. A first and second plurality of pedal keys are secured to the spring bars, in alternating fashion, with each key of one plurality disposed between a pair of the keys of the other plurality. In addition, each key of one plurality is secured to one end of each spring bar, with a key of the other plurality secured to the other end of the respective spring bar.

The keys of the one plurality are provided with blocks extending upwardly therefrom to extend above the nominal height of the second plurality, the blocks being adjustable in the longitudinal distance from the medial spacer bar. A plurality of electrical switches are provided, each disposed at the distal end of one of the keys to sense depression thereof. The keys are adapted to be played by the foot, using a heel-and-toe rocking motion. The notes ascribed to the keys may be selectively altered electronically, and generally comprise the notes of major and harmonic minor chords commonly used in bass accompaniment. The end portions of all keys are disposed to strike upper and lower cushioning pads to provide a softened blow upon full extension and return of the keys.

BRIEF DESCRIPTION OF THE DRAWING

FIG. 4 is an enlarged cross-sectional elevation taken through the pedals of the device.

FIG. 5 is an enlarged cross-sectional elevation taken through the pedals of the present invention.

FIGS. 6 and 7 are schematic layouts of possible musical note arrangements of the pedals of the present invention.

DESCRIPTION OF THE PREFERRED EMBODIMENT

The present invention generally comprises a musical instrument featuring a pedal keyboard. A salient aspect of the invention is that the keyboard is designed to facilitate the playing of rhythmic bass line accompaniment to a piano, guitar, or similar instrument played by the same musician. Thus the musician can employ the natural rhythmic expression of tapping the foot to add a bass accompaniment line to the melody provided by the other instrument played manually. However, another salient feature of the invention is that the notes ascribed to the keys may be altered electronically so that the musician may play any type of music or musical line thereof.

Figure 1:
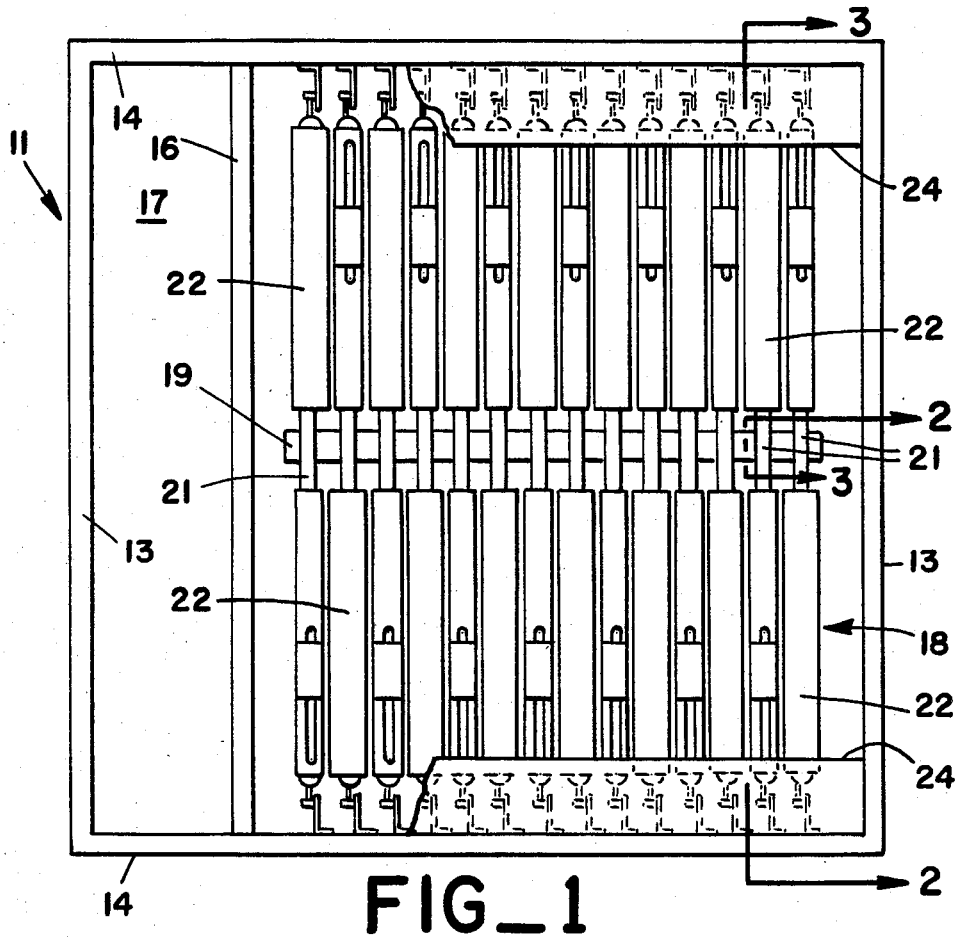
FIG. 1 is a plan view of the pedal keyboard of the present invention.
Figure 2:
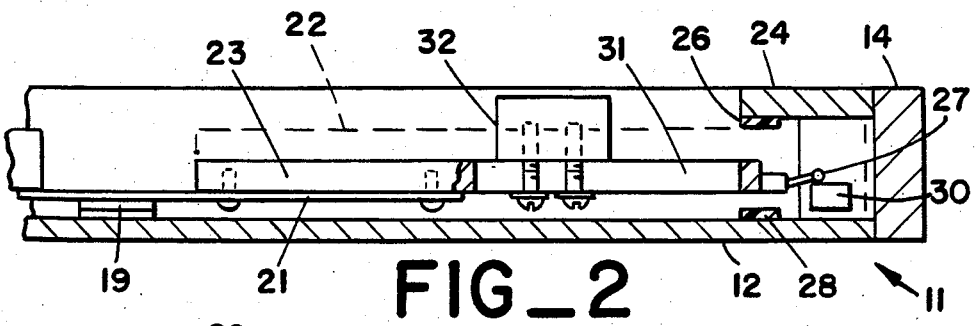
FIG. 2 is a cross-sectional elevation taken along line 2—2 of FIG. 1.
Figure 3:
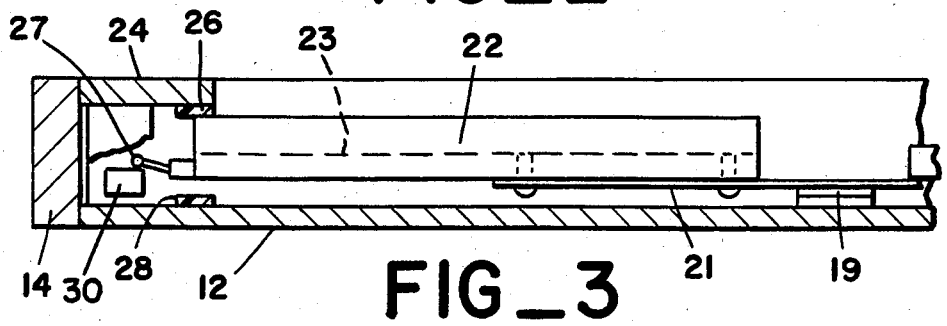
FIG. 3 is a cross-sectional elevation taken along line 3—3 of FIG. 2.

With regard to FIGS. 1–3, the present invention includes a housing 11 which is adapted to be supported on a floor or ground surface. The housing is comprised of a generally rectangular base panel 12, and laterally opposed, paired side walls 13 and 14 extending upwardly from the base panel. The base and sides define a shallow, upwardly opening rectangular coffer. An interior panel 16 extends between the side walls 14, dividing the coffer into a relatively narrow portion 17 for electronic circuitry, and a larger portion 18 which houses the pedal keyboard.

Within the portion 18 a spacer bar 19 is supported on the base panel and disposed to extend laterally and parallel to the sides 14. A plurality of linear spring members 21 are supported atop the bar 19 and extending longitudinally in generally orthogonal relationship to the bar 19. The linear spring members may comprise bars of spring steel or the like, and are arrayed in parallel, equally spaced fashion. The bar 19 generally bisects each of the members 21 to support the medial portion thereof, and the opposed ends of the members 21 are unsupported and adapted to be deflected downwardly and restored upwardly by the resilient nature of the material of the members 21.

The invention also includes a first plurality of pedal keys 22. The keys 22 are secured atop alternating ones of both ends of the plurality of members 21, so that each of the members 21 has a key 22 secured to only one end thereof. In addition, a second plurality of keys 23 is also provided, also secured atop alternating ones of both ends of the members 21. The keys are arrayed so that each of the first keys is disposed between a pair of the second keys, and so that each of the members 21 supports a key 22 at one end and a key 23 at the other end. The laterally adjacent distal ends of the adjacent keys 22 and 23 are disposed in lateral rows, with a switch actuator 27 extending longitudinally from all of the keys 22 and 23. Each actuator is disposed in confronting, actuating relationship with one of a plurality of electrical switches 30 which extend from the inner surfaces of sides 14. Each switch 30 is actuated by passage of the respective actuator on a downward excursion when the pedal is depressed by the foot. All of the switches 30 are connected by a cable (not shown) to electronic circuitry disposed in the area 17. The circuitry, which may comprise any electronic system known in the prior art for generating musical notes, is capable of creating differing scales, note arrangements for the keys, voices for the instrument, and the like.

As is clearly evident from FIG. 4, the plurality of keys 22 are substantially greater in height than the plurality 23, and have upper surfaces disposed in a nominal common plane which is disposed significantly higher than the nominal plane of the keys 23. The plane of the keys 22 is defined by a pair of flanges 24 extending horizontally inwardly from the upper edges of the sides 14. A pair of damping strips 26 each extend laterally along the underside of one of the flanges 24 to cushion the impact of the keys 22 and damp any sound created thereby. The resilient members 21 are deformed slightly to cause the spring restoring force thereof to bias the keys 22 upwardly so that the distal ends of the keys 22 impinge lightly on the strip 26.

A second pair of damping strips 28 is secured to the bottom 12, each disposed parallel to and in confronting relationship with one of the strips 26. The strips 28 thus are disposed to be struck by the distal ends of the keys 22 and 23 at the lower limit of their downward excursion. Each of the keys 23 includes a slot 31 extending vertically through a distal end portion of each key and adjacent to the respective distal end of the member 21. A plurality of blocks 32 are provided, each secured to one of the keys 23 by screws or the like extending through the respective slot 31. The outer configuration of the blocks is not necessarily important, but it is significant that the upper surfaces of the blocks are disposed in a nominal plane which is higher than the level of the keys 22. Also, the longitudinal position of each block with respect to the medial strip 19 may be adjusted along the length of each slot 31, to suit the comfort of the individual musician and the length of the foot from heel to toe.

The result of the relative dispositions of the upper surfaces of the keys 22 and 23 is that each key 23 forms a "valley" between a pair of keys 22, and this "valley" is easily perceptible by the sense of touch of the foot. (Using a shoeless foot is recommended, but not essential.) In addition, the blocks 32 extending from each key 23 present upper extents which are disposed above the height of the keys 22. These upwardly protruding members provide markers to indicate to the tactile sense of the foot the distance and position between pairs of keys. Thus the musician is given a great amount of tactile pedal information to facilitate playing the instrument with at least one foot while playing another instrument manually. Also, each key 22 may be actuated by the relatively broad foot surface without impinging on the adjacent keys, due to the fact that the adjacent keys are lower. In like fashion each of the keys 23 may be actuated by striking the respective block 32 thereof without impinging on the adjacent keys 22, due to the lower height of the latter.

It should be noted that the keys are arranged in two longitudinally opposed rows to facilitate playing one row with the toe and the other row with the heel. This may be accomplished most easily by positioning the medial portion of the foot over the member 19, and contacting and depressing the rows of keys with a rocking heel and toe motion. The resilient upward restoring force of the members 21 aids the rocking motion. This motion is a natural human expression of rhythm, and the present invention is ergonomically synergistic in taking advantage of this natural rhythmic tendency to express a generally rhythmic musical line such as a bass accompaniment line in contemporary music.

Indeed, with regard to FIG. 6, the arrangement of the notes ascribed to the plurality of keys 22 and 23 is selected in the preferred embodiment to facilitate the bass accompaniment line. This is accomplished electronically and instantaneously, with no alteration to the structure described above. For example, in the straight major configuration of FIG. 6, the notes are not arranged in the standard chromatic scale. Rather, the notes which form the typical bass accompaniment, such as the the tonic note C and its octave interval are adjacent in the upper row. The third note of the major chord is disposed directly opposite the tonic note, with the fifth note of the chord adjacent to the other side of the tonic note. Thus the rocking motion of the foot, which alternately plays the top and bottom rows, can be used to play a one-three-five sequence without requiring any substantial lateral movement of the foot. This would be extremely difficult do play using the foot on a chromatic scale arrangement. In addition, the commonly used fifth (dominant), fourth (subdominant), second (supertonic), sixth (submediant), third (mediant), and seventh (leading tone) chords and their related intervals are also ascribed to adjacent keys to fill out the typical bass line. It may be appreciated by those skilled in music that the note arrangements of other bass line harmonies may be stored in the memory of the electronic circuitry (such as a synthesizer) and switched instantly as the music requires.

However, it should be noted that the novel pedal keyboard of the present invention can be configured with the keys representing a common musical scale. As shown in FIG. 7, each longitudinally opposed pair of keys is designated as the same note, and adjacent keys are designated as having chromatic intervals. Thus the chromatic scale is represented, and the heel or toe may be used to play the same note. In this fashion the instrument could be used to emulate virtually any known keyboard instrument.

I claim:

1. A pedal keyboard musical instrument adapted for heel and toe playing, including; a base adapted to be supported on the ground, first and second pluralities of keys extending longitudinally above said base and arrayed in a pair of laterally extending, longitudinally opposed rows, said first and second pluralities being disposed in paired, alternating relationship with each of said first plurality disposed laterally adjacent to a pair of said second plurality, and each of said first plurality being disposed longitudinally opposite a key of said second plurality, support means extending laterally on said base and medially between said rows to support the proximal ends of both said pluralities of keys, said first plurality of keys including upper surface portions generally disposed in a first common plane, said second plurality of keys including upper surface portions generally disposed in a second common plane, said first common plane being spaced above said second common plane with respect to said base, and said second plurality of keys including extension means extending upwardly from said second common plane above said first common plane to a third common plane, each extension means being disposed longitudinally opposite a key of said first plurality in said first common plane.

2. The pedal keyboard musical instrument of claim 1, wherein said extension means includes a plurality of blocks, each secured to and extending upwardly from one of said second plurality of keys.

3. The pedal keyboard musical instrument of claim 2, further including means for selectively adjusting the longitudinal position of each of said blocks on its respective key.

4. The pedal keyboard musical instrument of claim 1, further including switch means coupled to each of the keys to sense depression of the keys and sound predetermined musical notes in response thereto.

5. A pedal keyboard musical instrument adapted for heel and toe playing, including; a base adapted to be supported on the ground, first and second pluralities of keys extending longitudinally above said base and arrayed in a pair of laterally extending, longitudinally opposed rows, said first and second pluralities being disposed in paired, alternating relationship with each of said first plurality disposed laterally adjacent to a pair of said second plurality, and each of said first plurality being disposed longitudinally opposite a key of said second plurality, support means extending laterally on said base and medially between said rows to support the proximal ends of both said pluralities of keys, said support means including a plurality of linear spring members disposed in longitudinal, parallel array and secured to said base, means for supporting each of said linear spring members at a medial portion thereof with freely disposed opposed ends, each of said first plurality of keys being secured to a distal end portion of each of said linear spring members, and one of said second plurality of keys being joined to the other distal end portion of the same linear spring member.

6. The pedal keyboard musical instrument of claim 5, further including a plurality of block members, each secured to one of said second plurality of keys and extending above the keys adjacent thereto.

7. The pedal keyboard musical instrument of claim 6, further including adjustment means for selectively varying the longitudinal position of each of said block members on its respective key.

8. The pedal keyboard musical instrument of claim 5, wherein each of said keys includes a portion which is disposed above the height of adjacent portions of the laterally adjacent keys.

9. The pedal keyboard musical instrument of claim 5, further including flange members extending from said base to engage the distal ends of said keys and limit the upward travel of said keys.

* * * * *